US006935936B2

(12) United States Patent
Goulet et al.

(10) Patent No.: US 6,935,936 B2
(45) Date of Patent: Aug. 30, 2005

(54) ABRADING MECHANISMS

(75) Inventors: Matthew G. Goulet, Milwaukee, WI (US); Craig S. Serio, New Berlin, WI (US); Michael M. Potempa, Oak Creek, WI (US); Brian S. Potempa, Oak Creek, WI (US); Tong Jin Kim, Chicago, IL (US); Michael H. Reedy, Chicago, IL (US); Michael D. Prince, Chicago, IL (US)

(73) Assignee: Newell Operating Company, Freeport, IL (US)

( * ) Notice: Subject to any disclaimer, the term of this patent is extended or adjusted under 35 U.S.C. 154(b) by 0 days.

(21) Appl. No.: 10/673,536

(22) Filed: Sep. 29, 2003

(65) Prior Publication Data

US 2004/0142647 A1 Jul. 22, 2004

Related U.S. Application Data

(60) Provisional application No. 60/416,284, filed on Oct. 3, 2002.

(51) Int. Cl.[7] ..... B24B 23/00

(52) U.S. Cl. ..... 451/344; 451/351; 451/356; 451/357

(58) Field of Search ..... 451/559, 351, 451/344, 552, 557, 356, 365, 357, 515, 525

(56) References Cited

U.S. PATENT DOCUMENTS

| | | | | | |
|---|---|---|---|---|---|
| 1,501,192 | A | | 7/1924 | Severns | |
| 1,544,368 | A | | 6/1925 | Brennan | |
| 2,635,396 | A | * | 4/1953 | Johnson | 451/356 |
| 2,711,059 | A | | 6/1955 | Ames | |
| 2,918,761 | A | * | 12/1959 | Earl et al. | 451/357 |
| 3,136,099 | A | * | 6/1964 | Tully et al. | 451/356 |
| 3,224,149 | A | | 12/1965 | Harrington et al. | |
| 4,075,793 | A | * | 2/1978 | Vogel et al. | 451/356 |
| 4,398,375 | A | * | 8/1983 | Malyuk | 451/356 |
| 4,475,317 | A | * | 10/1984 | Dicke | 451/356 |
| 4,768,310 | A | * | 9/1988 | Butts | 451/303 |
| 4,918,875 | A | | 4/1990 | Klocke | |
| 5,022,190 | A | * | 6/1991 | Hutchins | 451/357 |
| 5,245,797 | A | | 9/1993 | Milkie | |
| 5,512,010 | A | * | 4/1996 | Labad, Jr. | 451/344 |
| 5,616,072 | A | * | 4/1997 | Walz et al. | 451/356 |
| 5,720,654 | A | | 2/1998 | Mac Donald | 451/523 |
| 6,641,469 | B2 | * | 11/2003 | Deshler | 451/514 |

* cited by examiner

*Primary Examiner*—George Nguyen
(74) *Attorney, Agent, or Firm*—Marshall, Gerstein & Borun LLP

(57) ABSTRACT

Hand held abrading tools are disclosed. The abrading tools include clamping mechanisms to quickly and reliably secure sanding paper, bristled sheets, polishing cloths, and the like, to the tool, while at the same time providing the operator with increased agility and ability to reach relatively hard to reach or oddly shaped surfaces.

10 Claims, 8 Drawing Sheets

ABRADING MECHANISMS

CROSS-REFERENCE TO RELATED APPLICATION

This is a non-provisional patent application claiming the priority benefits under 35 U.S.C. §119(e) of provisional patent application No. 60/416,284, filed on Oct. 3, 2002.

FIELD OF THE DISCLOSURE

The present disclosure generally relates to hand tools and, more particularly, relates to hand tools for performing sanding or abrading activities.

BACKGROUND OF THE DISCLOSURE

In many construction, repair, and refurnishing projects it is necessary or desirable to sand a given surface. For example, in the refinishing of furniture, the prior varnish, paint, stain, etc. must be sanded or abraded off such that the new finish can be applied. Similarly, in the preparation of interior walls, it is often necessary to sand plaster or joint compound to provide a smooth surface prior to application of primer and paint. The same is true with respect to exterior painting wherein siding needs to be scraped and often sanded prior to application of the desired stain or paint.

With many of these activities, it is possible to use a power tool to prepare the surface. For example, power washers using pressurized water or sand blasters using pneumatic power to impart sand particles against the surface at high speeds can to be used to remove the prior surface. However, it is often still desirable to perform such sanding operations by hand. This is particularly true with respect to smaller projects, hard to reach areas, oddly shaped surfaces, detail work, wood working, or wherein cost is at a premium.

Various tools are therefore currently known to conduct such sanding operations. With one commonly used tool, known as a sanding block, a sheet of sand paper is wrapped around a flat surface of block and secured thereto at its ends using various mechanisms. Commonly, such securement is accomplished through the use of a wing nut or other threaded mechanism imparting a force against a securing plate which secures the sand paper to the block. U.S. Pat. Nos. 1,501,192 and 1,544,368 are two examples of such blocks. In still further devices, the block is made of flexible material such as rubber with slits being provided at each of the first and second ends of the block. The resulting flaps formed at the first and second ends can be deformed such that the sheet of paper may be inserted into the slits with teeth being provided therein to grip the paper once inserted.

While effective, none of the currently known manual sanding blocks are of optimal design. With the aforementioned wing and nut configurations, considerable time is employed in changing out each sheet of paper in that the entire length of the threaded shaft upon which the wing nuts are secured must be traversed by the wing nut itself before the plate can be removed for removal of the paper itself. With the latter mentioned rubber block, the operation itself is relatively awkward in that considerable force must be applied to the end flaps to sufficiently deform the flaps and enable the sheet to be removed. Moreover, since such significant levels of force are required, the risk of injury is increased in that the prongs or teeth within the block can puncture or otherwise harm the fingers of the operator.

SUMMARY OF THE DISCLOSURE

In accordance with one aspect of the disclosure, an abrading tool is disclosed which may comprise of a base, a handle, a first cam mechanism, and a second cam mechanism. The base may include first and second ends with the handle extending from the base. Each cam mechanism may be pivotally attached to one of the base first and second ends.

In accordance with another aspect of the disclosure, an abrading tool is provided which may comprise a base and a rigid cover. The base may be manufactured of flexible material with the rigid cover being removably mounted to the base and adapted to trap an abrading sheet between the base and cover.

In accordance with another aspect of the disclosure, an abrading tool is disclosed which may comprise a base, a handle, and first and second spring biased clamps. The base may include first and second ends with the handle extending from the base. Each of the first and second spring biased clamps may be mounted to one of the base first and second ends.

These and other aspects and features of the disclosure will be more readily apparent upon reading the following detailed description when read in conjunction with the accompanying drawings.

Figure 1:
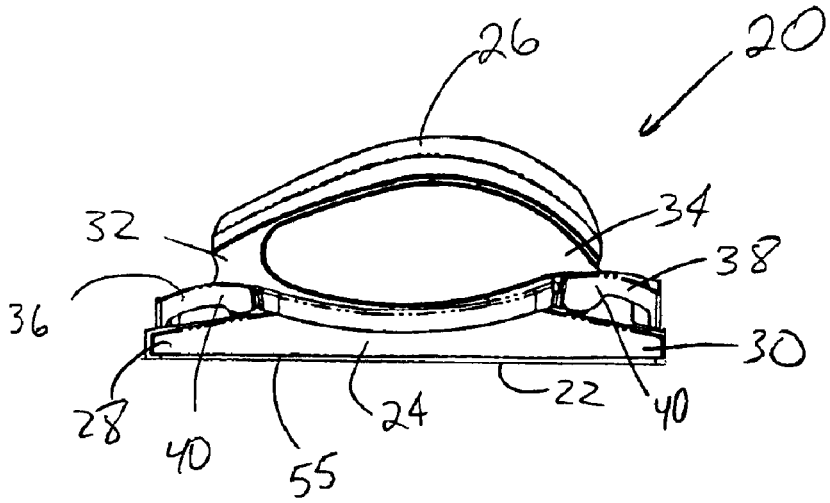
FIG. 1 is a side view of a first embodiment of an abrading tool constructed in accordance with the teachings of the disclosure.
Figure 2:
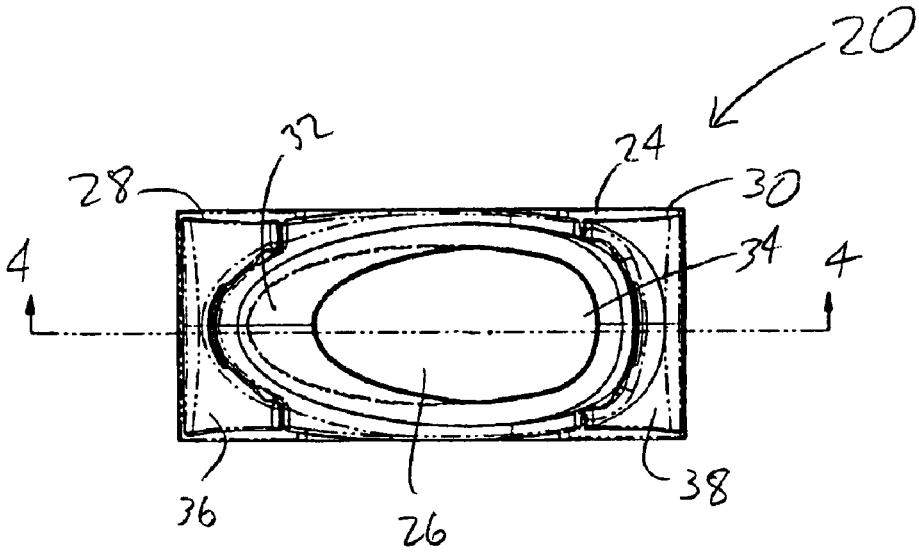
FIG. 2 is a top view of the abrading tool of FIG. 1.

The disclosure is susceptible to various modifications and alternative constructions, certain illustrative embodiments thereof have been shown in the drawings and will be described below in detail. It should be understood, however, that there is no intention to limit the disclosure to the specific forms disclosed, but on the contrary, the intention is to cover all modifications, alternative constructions, and equivalents falling within the spirit and scope of the invention as defined by the appended claims.

DETAILED DESCRIPTION OF THE DISCLOSURE

Referring now to the drawings, and with specific reference to FIG. 1, a first embodiment of an abrading tool constructed in accordance with the teachings of the disclosure is generally referred to by reference numeral 20. One of ordinary skill in the art will readily recognize the general category of tool represented by the abrading tool 20 is that of sanding blocks. Such a block is adapted to hold replaceable sheets of sand paper or other abrading sheets 22 for refinishing or otherwise abrading a surface to be prepared (not shown). As used herein abrading tools are defined as any type of equipment used, to condition a surface through friction and accordingly would include sanders, polishers, scrubbers, or the like.

Figure 3:
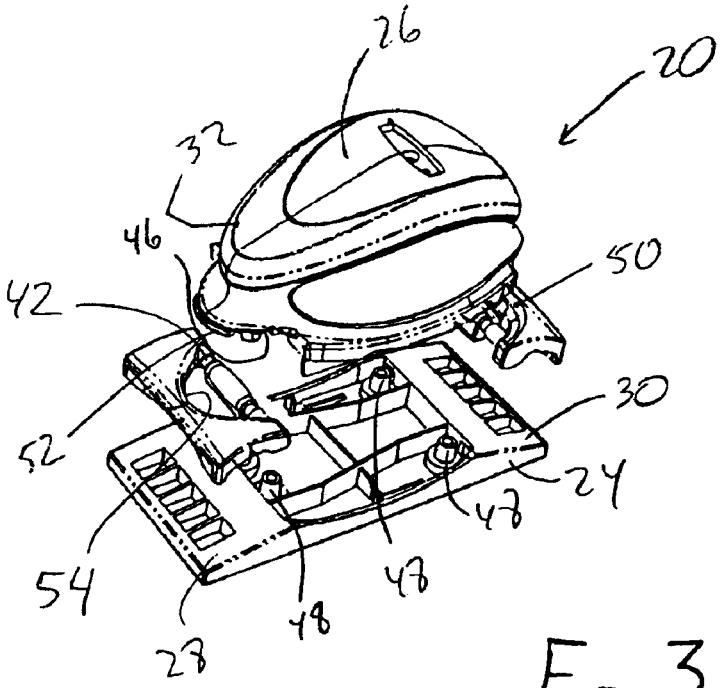
FIG. 3 is an exploded view of the abrading tool of FIG. 1.

As shown best in FIG. 3, the abrading tool 20 includes a base 24 to which a handle 26 is secured. The base 24 includes first and second ends 28, 30. The handle 26 also includes first and second ends 32, 34. Mounted to each of the first and second handle ends 32, 34 are cam mechanisms 36, 38, respectively. In addition, while each of the embodiments depicted and discussed include a built in handle, the scope of the invention includes embodiments without handles attached, but wherein a handle such as an extension pole or the like can be attached.

More specifically, each of the first and second cam mechanisms 36, 38 includes a pivot arm 40 extending from an axle 42, with a cam 44 mounted to the axle 42 as well. Mounting grooves 46 are provided within the handle 26 for receipt of the axle 42 such that when the base 24 is secured to the handle 26, the axle 42 is captured therebetween in a rotational fashion. One of ordinary skill in the art will readily understand that the base 24 and handle 26 can be so secured in any number of fashions including through the use of adhesive, rivets or other fasteners with the preferred embodiment providing a number of wells 48 within the base 24 for receipt of a fastener (not shown) such as a threaded screw for attachment of the base 24 to the handle 26.

Figure 4:
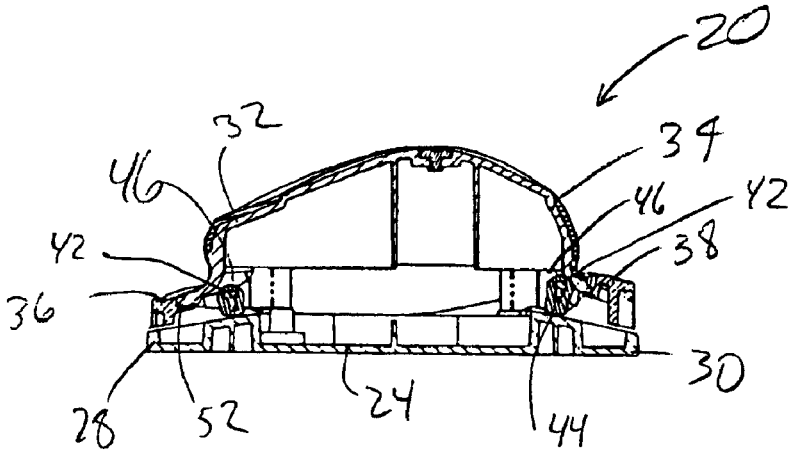
FIG. 4 is a sectional view taken along line 4—4 of FIG. 1.

Turning now to FIG. 4, it will be noted that the diameter of the cam 44 is such that it does not freely clear the base ends 28 and 30, rather significant force must be applied to the pivot arm 40 50 as to compress the cam 44 against the first and second base ends 28 and 30 and thus secure the abrading sheet 22 therebetween. It is therefore desirable to manufacture the cam 44 from a compressible material such as rubber or the like. By compressing the cams 44 against the paper 22, not only is the paper secured but it is pulled taught across the base 24 as well. Moreover, as used herein, abrading paper of abrading sheets are defined as sand paper, scrubbing surfaces including bristles, polishing clothes, and the like.

Once so compressed, the pivot arm 40 can be secured into a locked position through the use of locking mechanisms 50. Any number of such mechanisms can be employed with the preferred embodiment using ledges 52 extending from the handle first and second ends 32 and 34 and by providing recesses 54 within the pivot arms 40 having a radius of rotation which is slightly less than the dimension between the mounting grooves 46 and the ledge 52. In other words the arc of rotation of the pivot arm 40 is such that it cannot freely navigate past the ledge 52, but rather must be deformed outwardly as to overcome the ledge 52 when moving from the locked position to the unlocked position.

In operation, it can therefore be seen that in order to attach and detach an abrading sheet from the abrading tool 20, the pivot arms 40 simply need to be rotated from the downward or locked position wherein the cams 44 compress against the base first and second ends 28 and 30 and thereby against the abrading sheet 22, to an upper or unlocked position wherein the cams 44 are moved out of engagement with the first and second ends 28 and 30. In order to do so, however, significant upward force must be applied to the pivot arm 40 so as to clear the recess 54 past the ledge 52. A layer of cushioned rubber or plastic material 55 may be provided on a bottom surface 56 of the base 24 to better grip the abrading sheet 22 and provide enhanced ability for the abrading tool 20 to access surfaces to be abraded.

In the depicted embodiment, the entire abrading tool 20 is manufactured from plastic materials. A variety of thermoplastic resins could be used to manufacture the device including polyethylenes, (e.g., HDPE or LDPE), polypropylenes, polyethyleneterephthalate, polyvinylchloride and, polycarbonate. Various thermoplastic elastomers such Santoprene® products available through Advanced Elastomers Systems, LP, of Akron, Ohio may also be used to provide rubbery gripping surfaces on the handles.

Figure 5:
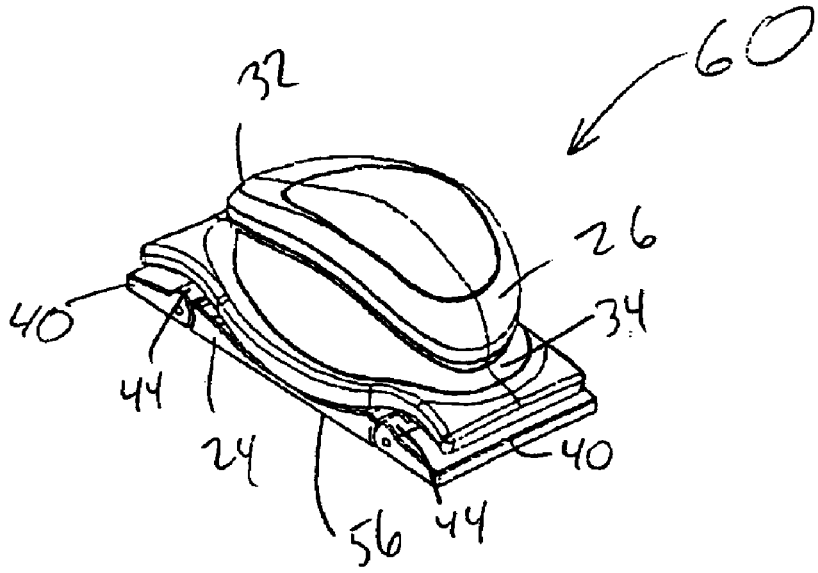
FIG. 5 is a perspective view of a second embodiment of an abrading tool constructed in accordance with the teachings of the disclosure.
Figure 6:
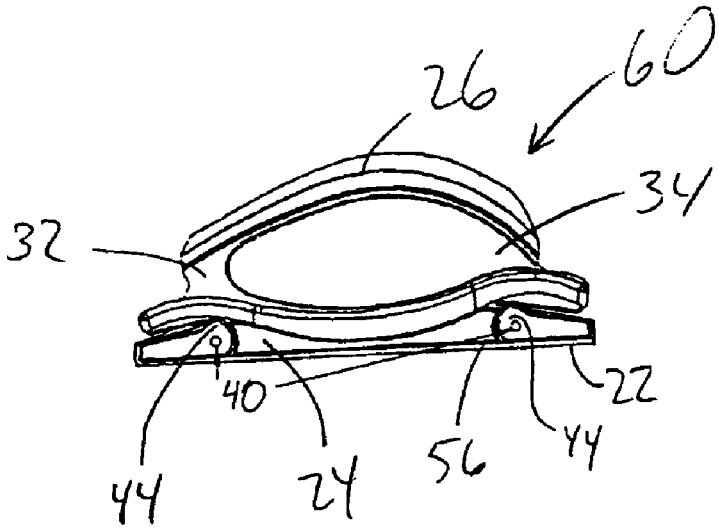
FIG. 6 is a side view of the abrading tool of FIG. 5.
Figure 7:
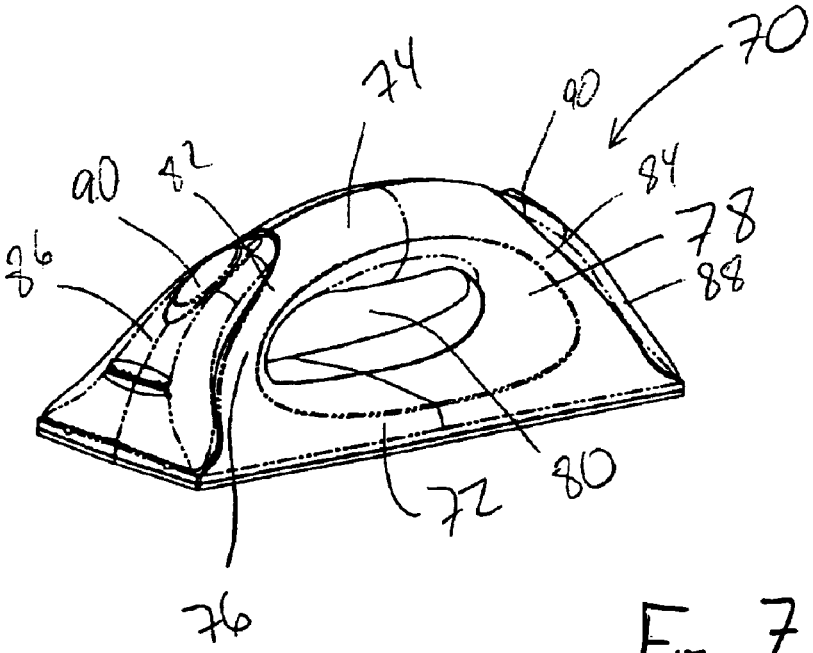
FIG. 7 is a perspective view of a third embodiment of an abrading tool constructed in accordance with the teachings of the disclosure.
Figure 8:
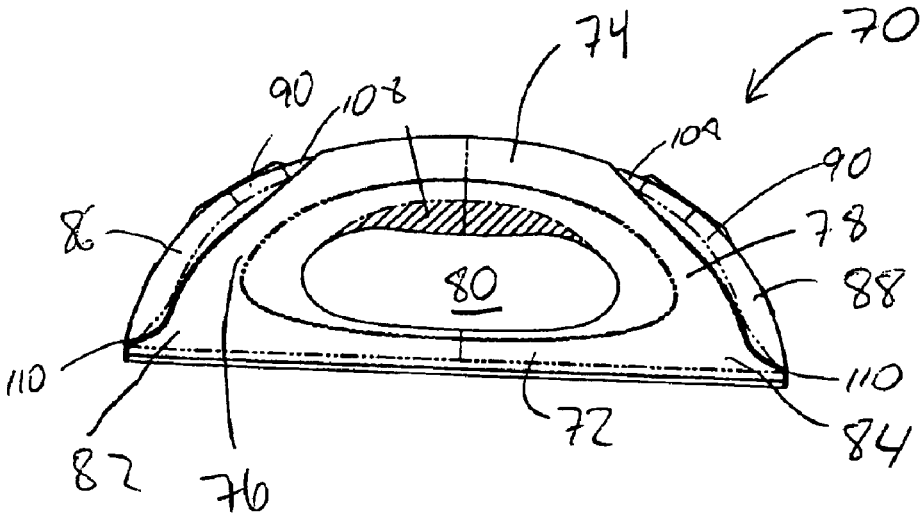
FIG. 8 is a side view of the abrading tool of FIG. 7.
Figure 9:
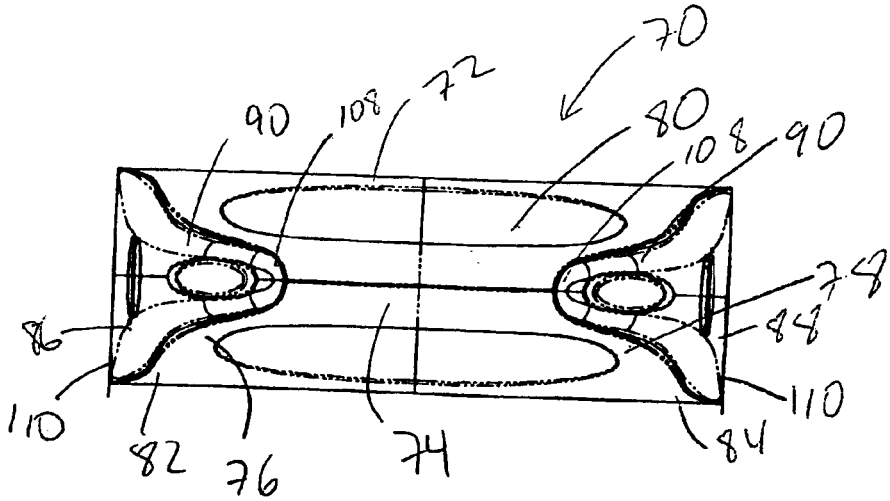
FIG. 9 is a top view of the abrading tool of FIG. 7.
Figure 10:
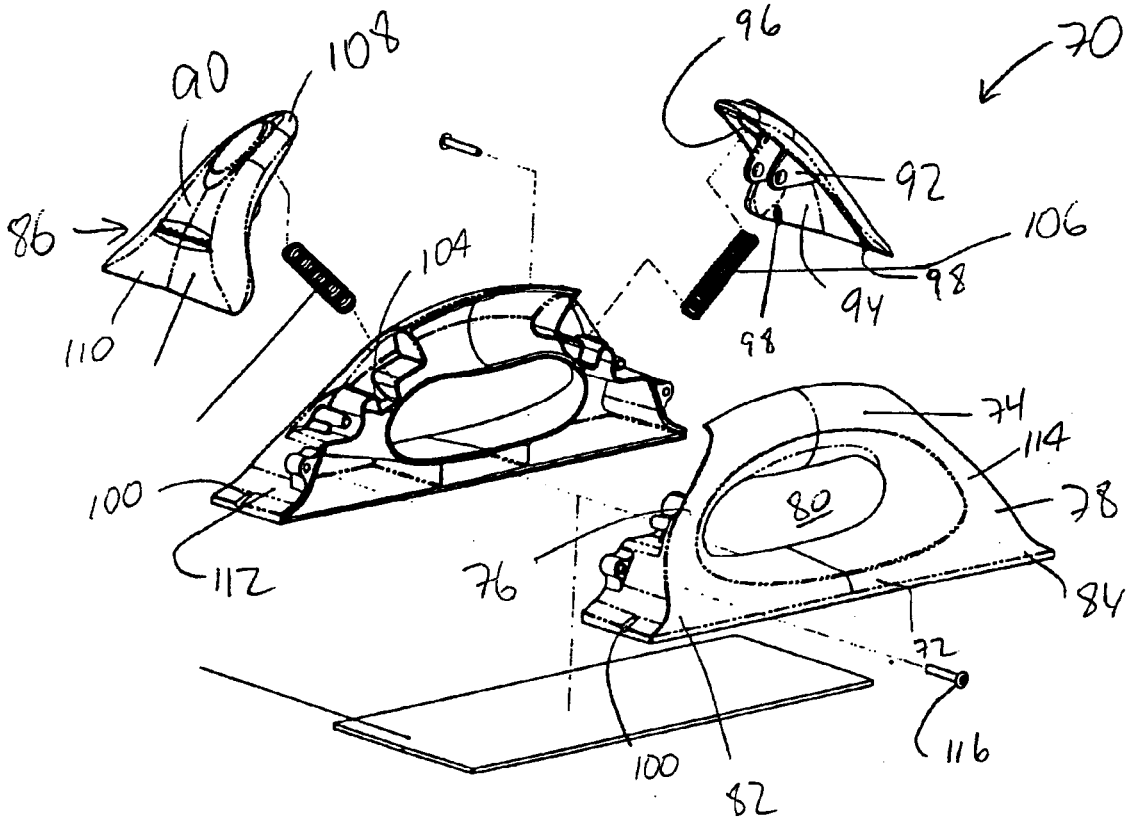
FIG. 10 is an exploded view of the abrading tool of FIG. 7.

In a related embodiment to that depicted in FIGS. 1–4, an abrading tool 60 is disclosed wherein the cams 44 may be provided on pivot arms 40 adapted to rotate below the handle 26 of the abrading tool 60 as opposed to the top of the abrading tool 60. This embodiment is depicted in FIGS. 5 and 6. In so doing, the pivot arms 40 themselves form part of the bottom surface 56 against which the abrading sheet resides during use. Like reference numerals to those with respect to the first embodiment are employed in this second embodiment.

Turning now to FIGS. 7–11, a third embodiment of an abrading tool constructed in accordance with the teachings of the disclosure is generally referred to by reference numeral 70. As shown therein, an abrading tool 70 includes a base 72 from which extends a handle 74 in a unitary fashion. First and second bridges 76, 78 connect the handle 74 to the base 70 to thereby provide a thru-hole 80 for receipt of a hand of the operator.

The abrading tool 70 further includes first and second ends 82, 84 to which are mounted first and second clamping mechanisms 86 and 88, respectively. Any number of different types of clamps 86, 88 may be employed with the preferred embodiment using one with a pivot arm 90 from which a pair of mounting struts 92 (FIG. 10) inwardly extend. An inner surface 94 of the pivot arm 90 further includes a spring recess 96, as well as first and second paper gripping teeth 98. Of course, in alternative embodiments, more than two teeth 98 can be provided. Regardless of the number of teeth 98 employed, a complimentary number of recesses 100 would be provided within the base 72 of an abrading tool 70. As one of ordinary skill in the art will readily understand, the teeth 98 and recesses 100 can be advantageously employed to securely grip abrading sheets 102 (FIG. 11) between the pivot arm 90 and the base 72.

Figure 11:
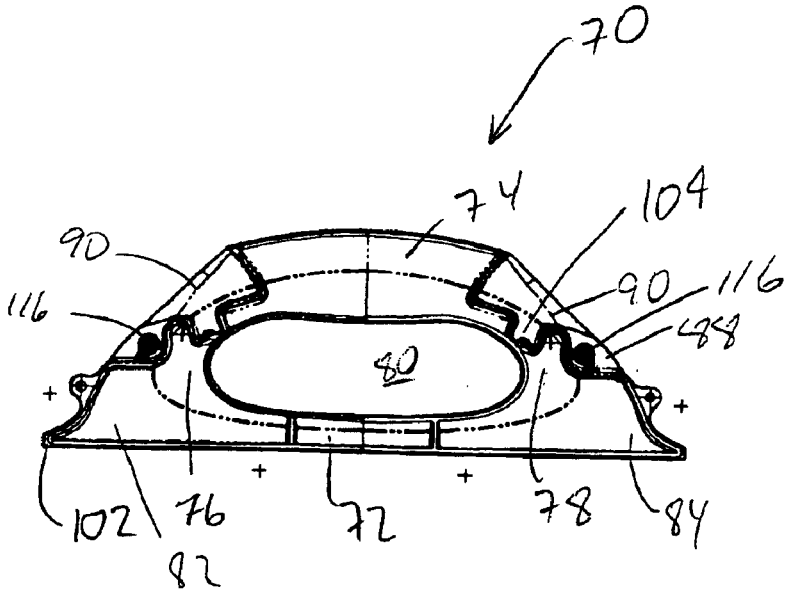
FIG. 11 is a sectional view of the abrading tool of FIG. 7 taken along line 11—11 of FIG. 7.
Figure 12:
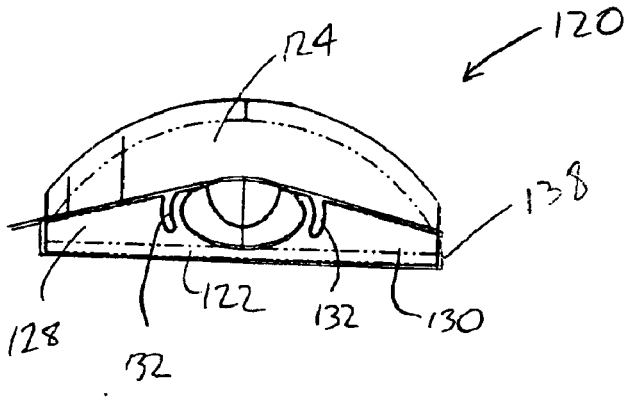
FIG. 12 is a side view of a fourth embodiment of an abrading tool constructed in accordance with the teaching of the disclosure.
Figure 13:
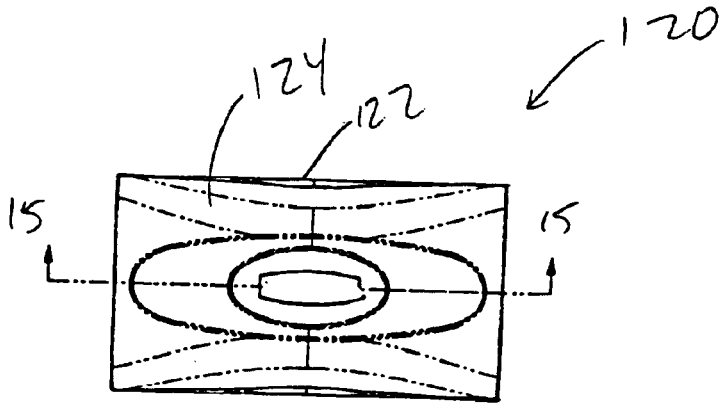
FIG. 13 is a top view of the abrading tool of FIG. 12.
Figure 14:
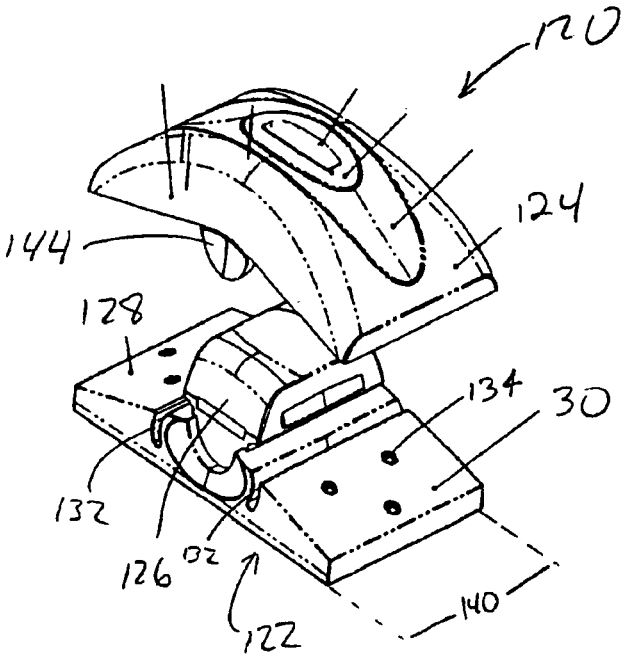
FIG. 14 is a exploded view of the abrading tool of FIG. 12.
Figure 15:
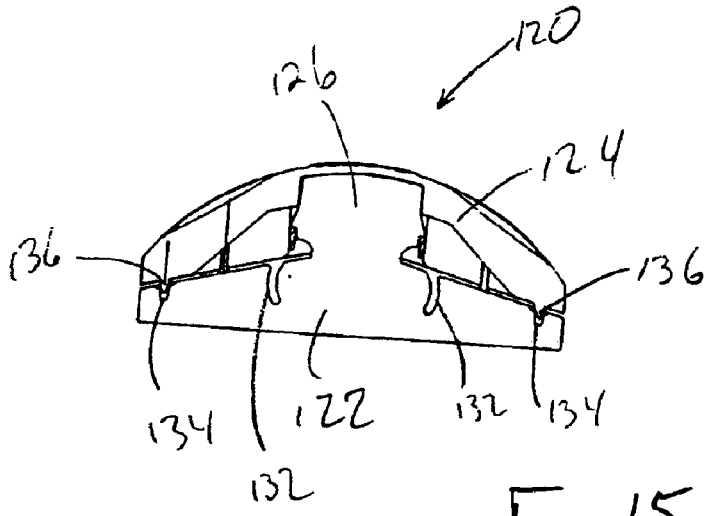
FIG. 15 is an sectional view of the abrading tool of FIG. 12 taken along line 15—15 of FIG. 12.
Figure 16:
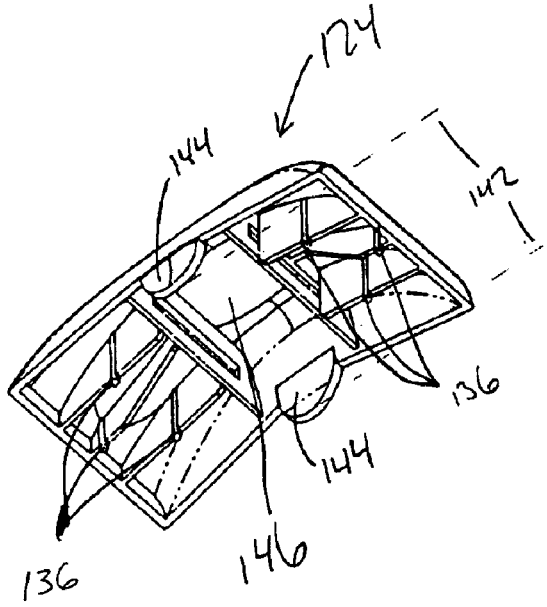
FIG. 16 is a bottom view of the cover of the abrading tool of FIG. 12.

With specific reference to FIG. 11, the abrading tool 70 is shown in sectional view to include a recess 104 to house a spring 106. Accordingly, the spring 106 is captured between the recess 104 and the recess 100 to thus constantly exert outwardly biasing force against a top end 108 of the pivot arm 90 and thus an inward compressive force against a bottom end 110 relative to the base 72. From FIG. 10, it will also be appreciated that from a manufacturing standpoint, the abrading tool 70 is preferably manufactured from first and second complimentary halves 112, 114. A pivot pin 116 is secured therebetween to serve as the fulcrum for the pivot arm 90.

Turning now to FIGS. 12–16, a fourth embodiment of an abrading tool constructed in accordance with the teachings of the disclosure is generally referred to by reference numeral 120. As shown therein, the abrading tool 120 includes a base 122 to which is removably secured a cover 124. Preferably the base 122 is manufactured from a flexible or otherwise malleable material such as any number of thermoplastic elastomers such as those of the Santoprene® family of products, rubber, or the like. With specific reference to the exploded view of FIG. 14, the base 122 is shown to include a mounting hub 126 centrally located between first and second end flaps 128 and 130. Flexing grooves 132 are provided between the end flaps 128 and 130 and the mounting hub 126 so as to enable the base 122 to achieve any number of different configurations and thus enable a user to more readily apply abrasive force to the surface to be prepared.

Each of the end flaps 128 and 130 includes a plurality of recesses 134 adapted to receive a complimentarily numbered set of engagement teeth 136. In so doing, one of ordinary skill in the art will readily recognize that an abrading sheet 138 can be secured between the base 122 and 124 when the cover 124 is compressed over the base 122 to a degree sufficient to cause the engagement teeth 136 to puncture the abrading sheet 138 and enter the recesses 134.

In order to secure the cover 124 to the base 122, the width 140 of the mounting hub 126 is made slightly wider than the width 142 of the cover 124. More specifically, first and second ears 144 downwardly depend from the cover 124 and it is the distance therebetween which is slightly less than the width of the mounting hub 126. It will also be noted that the cover 124 includes a recess 146 adapted to receive the entirety of the mounting hub 126 when it is desired to secure the abrading sheet 138 to the abrading tool 120.

In operation, it can therefore be seen that the abrading tool 120 can be used by wrapping the abrading sheet 138 about the base 122, pulling the end flaps 128, 130 away from the cover 124, inserting the ends of the sheet 138 between the end flaps 128, 130 and cover 124, and releasing. In so doing, the engagement teeth 136 puncture the paper 138 and enter into the recesses 134. By providing the flexing grooves 132 between the end flaps 128, 130 and mounting hub 126, the end flaps 128, 130 can more easily be pulled away from the cover 124 than with prior art sanding blocks.

From the foregoing, it will be noted that a number of different embodiments for an abrading tool are disclosed which increase the speed with which abrading sheets can be replaced while improving the comfort of the operator and improving the ability of the operator to reach relatively non-uniformly shaped surfaces.

What is claimed is:

1. An abrading tool, comprising:

a base having first and second base ends;

a handle extending from the base and having first and second handle ends;

an abrasive element releasably secured to the base;

a first cam mechanism pivotally attached to the first handle end and including a first cam body extending from a first axle; and a second cam mechanism pivotally attached to the second handle end and including a second cam body extending from a second axle, the first and second cam mechanisms being adapted to releasably secure the abrasive element to the base.

2. The abrading tool of claim 1, wherein the first cam mechanism includes a first pivot arm capable of rotation about the first axle, and the second cam mechanism includes a second pivot arm capable of rotation about the second axle, the first cam body exerting compressive force against the base when the first pivot arm is rotated into a locked position, the first cam body being disengaged from the base when the first pivot arm is rotated in an unlocked position, and the second cam body exerting compressive force against the base when the second pivot arm is rotated into a locked position, the second cam body being disengaged from the base when the second pivot arm is rotated in an unlocked position.

3. The abrading tool of claim 2, wherein the first and second cam bodies are manufactured from a compressible material.

4. The abrading tool of claim 2, wherein each cam mechanism includes a lock to secure the pivot arms in the locked positions.

5. The abrading tool of claim 4, wherein each lock includes a ledge extending from one of the handle first and second handle ends, the pivot arms being adapted to rotate past the ledges, the pivot arms having an inner recess, the inner recess having an arc of rotation, the ledge lying in the arc of rotation.

6. The abrading tool of claim 4, wherein the abrading tool is made of plastic.

7. The abrading tool of claim 1, further including a compressible layer provided on a bottom surface of the base.

8. The abrading tool of claim 1, wherein the first handle end includes a first mounting groove adapted to receive the first axle, and the second handle end includes a second mounting groove adapted to receive the second axle.

9. The abrading tool of claim 8, wherein the first axle is secured between the first mounting groove and the base, and the second axle is secured between the second mounting groove and the base.

10. A method of releasably attaching an abrasive element to an abrading mechanism, comprising:

providing an abrading mechanism comprising a base, the base including first and second base ends, the base further including a handle extending from the base, the handle including first and second handle ends, the first handle end including a first pivotally attached cam mechanism, the first cam mechanism including a first cam body extending from a first axle, and the second handle end including a second pivotally attached cam mechanism, the second cam mechanism including a second cam body extending from a second axle;

providing an abrasive element for releasable attachment to the base, the abrasive element including first and second ends;

rotating the first cam mechanism such that the first cam body is disengaged from a top section of the first base end;

rotating the second cam mechanism such that the second cam body is disengaged from a top section of the second base end;

positioning the first end of the abrasive element between the top section of the first base end and the disengaged first cam body;

positioning the second end of the abrasive element between the top section of the second base end and the disengaged second cam body;

rotating the first cam mechanism such that the first end of the abrasive element is engaged between the first cam body and the top section of the first base end; and rotating the second cam mechanism such that the second end of the abrasive element is engaged between the second cam body and the top section of the second base end, thereby releasably attaching the abrasive element to the abrading mechanism.

* * * * *